US007988024B2

(12) United States Patent
Jankoski et al.

(10) Patent No.: US 7,988,024 B2
(45) Date of Patent: Aug. 2, 2011

(54) BEACH EQUIPMENT CARRYING APPARATUS

(75) Inventors: Frank Jankoski, Pennington, NJ (US); Anita Saynisch, Pennington, NJ (US); Ronald F. Jones, Fairfax Station, VA (US); Joyce J. Jones, Fairfax Station, VA (US)

(73) Assignee: Beachpacker, LLC, Fairfax Station, VA (US)

( * ) Notice: Subject to any disclaimer, the term of this patent is extended or adjusted under 35 U.S.C. 154(b) by 726 days.

(21) Appl. No.: 10/364,705

(22) Filed: Feb. 12, 2003

(65) Prior Publication Data

US 2003/0150895 A1 Aug. 14, 2003

Related U.S. Application Data

(60) Provisional application No. 60/356,159, filed on Feb. 14, 2002.

(51) Int. Cl.
*A45F 3/00* (2006.01)
*A45F 3/04* (2006.01)

(52) U.S. Cl. ..... 224/635; 224/682; 224/680; 224/636; 224/637; 224/638; 224/652

(58) Field of Classification Search ..... 224/635, 224/636, 637, 638, 639, 651, 652, 682, 684, 224/680
See application file for complete search history.

(56) References Cited

U.S. PATENT DOCUMENTS 2,490,367 A 12/1949 Maddocks
3,219,243 A * 11/1965 Mack et al. ..... 224/262
3,307,758 A 3/1967 Platt
3,648,907 A * 3/1972 Romney ..... 224/153
3,662,932 A 5/1972 Kerschner
3,733,017 A * 5/1973 Pletz ..... 224/634
3,734,366 A * 5/1973 Wood ..... 224/635
3,860,157 A * 1/1975 Richards et al. ..... 224/153
3,889,859 A * 6/1975 Joseph ..... 224/634
4,013,201 A * 3/1977 Potter ..... 224/262
4,087,031 A * 5/1978 Fenner ..... 224/602
4,179,053 A * 12/1979 Figura ..... 224/190
4,214,685 A * 7/1980 Pletz ..... 224/634
4,248,367 A * 2/1981 Buel ..... 224/153
4,286,739 A 9/1981 Silcott et al.
4,487,345 A 12/1984 Pierce et al.
4,489,866 A * 12/1984 Korte ..... 224/155
4,491,258 A * 1/1985 Jones ..... 224/153
4,515,300 A * 5/1985 Cohen ..... 224/153
4,530,451 A 7/1985 Hamilton
4,577,901 A 3/1986 Phillips
4,676,584 A 6/1987 Perlin
4,687,248 A 8/1987 Ross et al.
4,720,029 A 1/1988 Varanakis
4,773,547 A 9/1988 Bell
4,885,812 A * 12/1989 Lindner ..... 5/113
4,947,798 A * 8/1990 De Wispelaere ..... 119/53
5,004,134 A 4/1991 Barry (Continued)

*Primary Examiner* — Tri M Mai
(74) *Attorney, Agent, or Firm* — Sughrue Mion, PLLC

(57) ABSTRACT

The present invention is a beach equipment carrying apparatus which is used to carry various items needed and used when visiting a beach or similar location. The apparatus includes a frame member, which can be adjustable in height, on which a plurality of components and compartments can be connected. The present invention further includes a hanger or hangers which are mounted to the frame member and on which beach going materials can be hung, including beach chairs. The present invention can also include a number of straps connected to the frame member to be used as shoulder straps, support straps or straps to hold down items secured to the apparatus.

27 Claims, 4 Drawing Sheets

U.S. PATENT DOCUMENTS 5,160,073 A * 11/1992 Bateman ..... 224/636
5,289,958 A 3/1994 Jay
5,318,342 A 6/1994 Hale
5,533,654 A * 7/1996 Holty et al. ..... 224/155
5,562,236 A * 10/1996 Monzingo ..... 224/153
5,564,612 A * 10/1996 Gregory ..... 224/633
5,609,278 A * 3/1997 Fresco ..... 224/153
5,893,504 A 4/1999 Baronian et al.
5,957,355 A * 9/1999 Swetish ..... 224/627
6,347,730 B1 * 2/2002 Frederick ..... 224/259
6,651,853 B2 * 11/2003 Higgins et al. ..... 224/155

* cited by examiner

BEACH EQUIPMENT CARRYING APPARATUS

PRIORITY

This application claims benefit of Provisional Application No. 60/356,159 filed Feb. 14, 2002; the disclosure of which is incorporated herein by reference.

BACKGROUND OF THE INVENTION

1. Field of the Invention

The present invention relates to an apparatus designed to provide a single carrying unit for the transport of multiple items and materials to and from the beach or other similar or related recreational area. The present invention is designed to provide a comfortable, yet multi-purpose apparatus that accommodates a large number of items unusually associated with beach activities.

2. Discussion of the Related Art

In most cases, a family outing to the beach is a bothersome and oftentimes trying expedition generating frustration, exertion and torment. The numbers of items necessary to satisfy the needs and wants of a family outing usually requires multiple sets of hands, sturdy backs and patience. All too often the necessary supplies require multiple trips to and from the beach house or transporting vehicle and the involvement of more than a single person carrying supplies.

The typical backpack type of carrying unit is too big and cumbersome to be useful or too small to accommodate the needed articles for a full day's outing. Most do not use a rigid frame to provide support and stability. Others are simply canvas bags into which items, including chairs are inserted and use shoulder harnesses to carry the bag. Still others are actually converted beach chairs with pockets attached to carry a small number of items. The present invention is designed to overcome the shortfalls of these other types of units, while providing the necessary variations in construction and utility to satisfy most often required needs for a single days outing.

SUMMARY OF THE INVENTION

The present invention is directed to solving the above problems and contains an external framed beach equipment carrying apparatus for carrying foldable beach chairs and other accessories. Along the frame, at various points, are mounting screws, rivets, bolts, velcro, etc. (or equivalent fastening methods) that are used to attach numerous utility straps, belts and shoulder harnesses. The purpose of the frame is to provide support and comfort to the user while acting as a mounting mechanism for the various attachments.

The frame is comprised of an external aluminum (or other suitable material) tube frame with angled supports or hangers at the top of the frame to attach and carry various items, for example, foldable chairs. The frame can be rectangular in shape and contain horizontal support bars for frame rigidity and for mounting additional backpack materials. The hanger(s) can be fixed to the frame by any commonly known or used method, such as rivets, screws, bolts, etc., and can also be hinged and/or collapsible (flush against pack) when not in use. The hanger(s) can be made from any commonly known or available rigid material such as aluminum and can be made as separate flat bars extending from each side of the vertical support, or can be a single "U" shaped member extending from one vertical support to the other. Vertical and horizontal straps, which are attached to the frame by any commonly known or used method such as bolts, rivets, screws or sewn loops, etc., are used to further secure the chairs or other items. The vertical and horizontal straps can also be detachable and fitted with quick release buckles.

BRIEF DESCRIPTION OF THE DRAWINGS

The advantages, nature and various additional features of the invention will appear more fully upon consideration of the illustrative embodiment of the invention which is schematically set forth in the drawing, in which.

DETAILED DESCRIPTION OF THE INVENTION

The present invention will be explained in further detail by making reference to the accompanying drawings, which do not limit the scope of the invention in any way.

Turning now to FIGS. 1-4, the present invention is an external framed beach equipment carrying apparatus 100 for carrying foldable beach chairs and other accessories. Along the frame 10, at various points, are mounting screws 11 and/or rivets that are used to attach various/numerous utility straps, belts and shoulder harnesses. Although screws 11 and rivets are shown being used in the Figures, it is noted that any other known or commonly used means or methods can be used, including Velcro, spot welding, bolts, etc.

Figure 3:
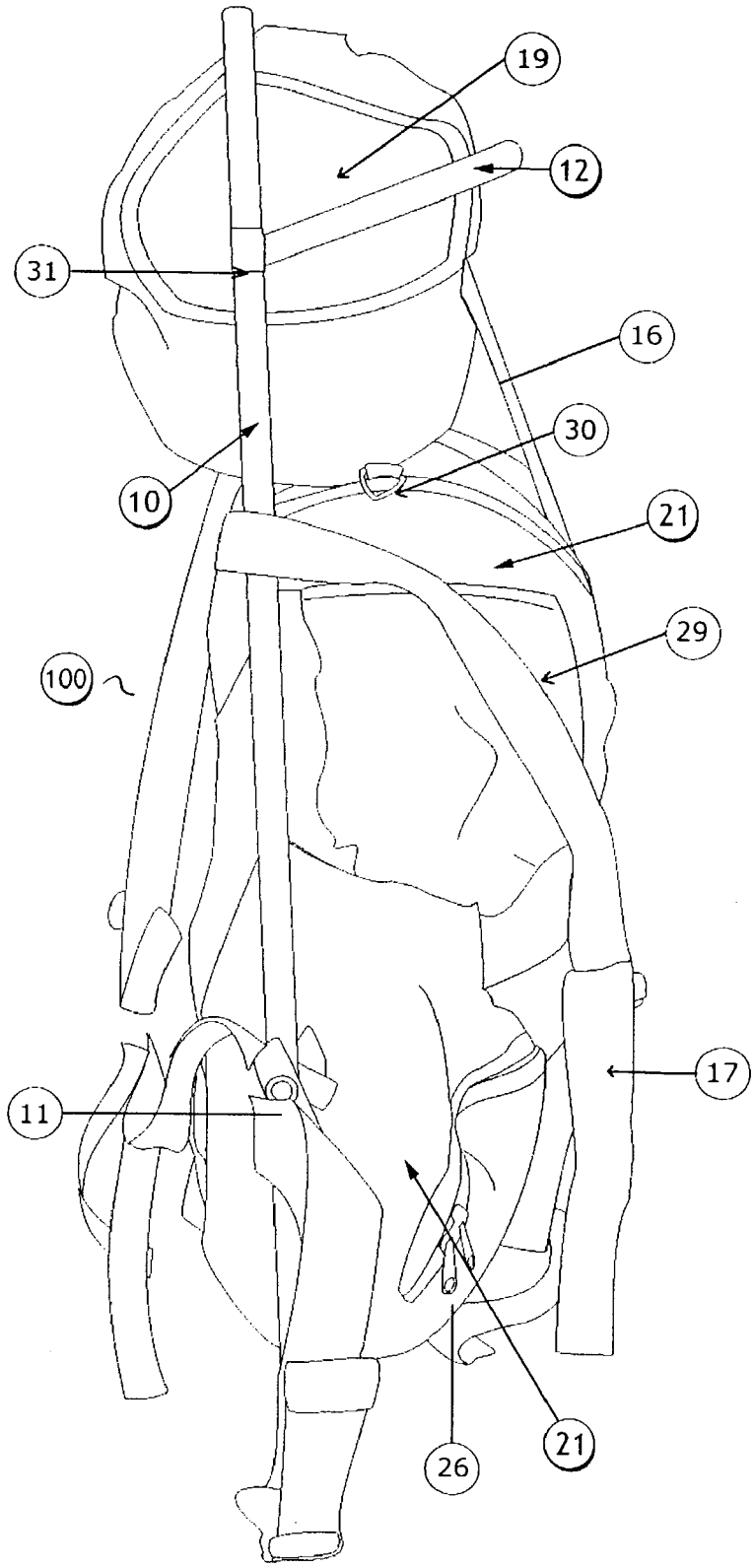
FIG. 3 is a diagrammatical representation of a side of the beach equipment carrying apparatus of the present invention.
Figure 4:
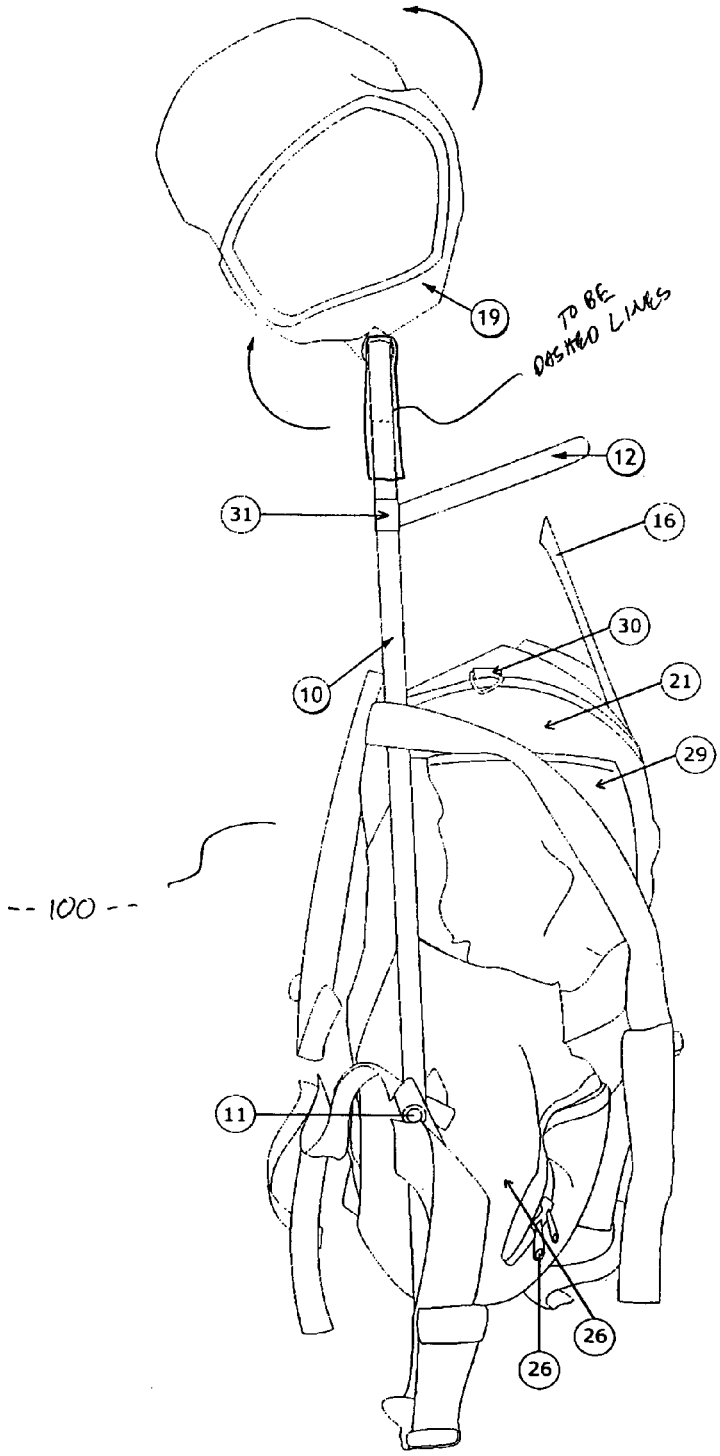
FIG. 4 is a diagrammatical representation of the side of the beach equipment carrying apparatus of the present invention, shown with the upper bag in an upper position.

The purpose of the frame 10 is to provide support and comfort to the user while acting as a mounting mechanism for the various attachments. The frame 10 is comprised of an external aluminum (or other suitable material) tube frame with angled supports or hangers 12 at, or near, the top of the frame 10 to attach and carry various items, for example, foldable chairs. The frame 10 is rectangular in shape and contains horizontal support bars 22 for frame rigidity and for mounting additional backpack materials. The support bars can be secured to the vertical portions of the frame 10 by any suitable means, such as: welding, spot welding, and/or fasteners 11. It is also noted that the shape and size of the frame can be changed or altered to optimize its particular use. It is further noted that although the frame 10 is shown as being a single unit in FIGS. 1 through 4, the frame 10 can also be made in more than one sections, allowing the frame 10 to be made adjustable. For example, as shown in FIG. 4, it is contemplated that one portion of the frame 10 can be made insertable into the other portion, and have a means to adjust and secure the height of the frame 10 pieces. The adjustment mechanism can include springs, bolts, quick-lease pins, or any other known or commonly used devices.

Figure 1:
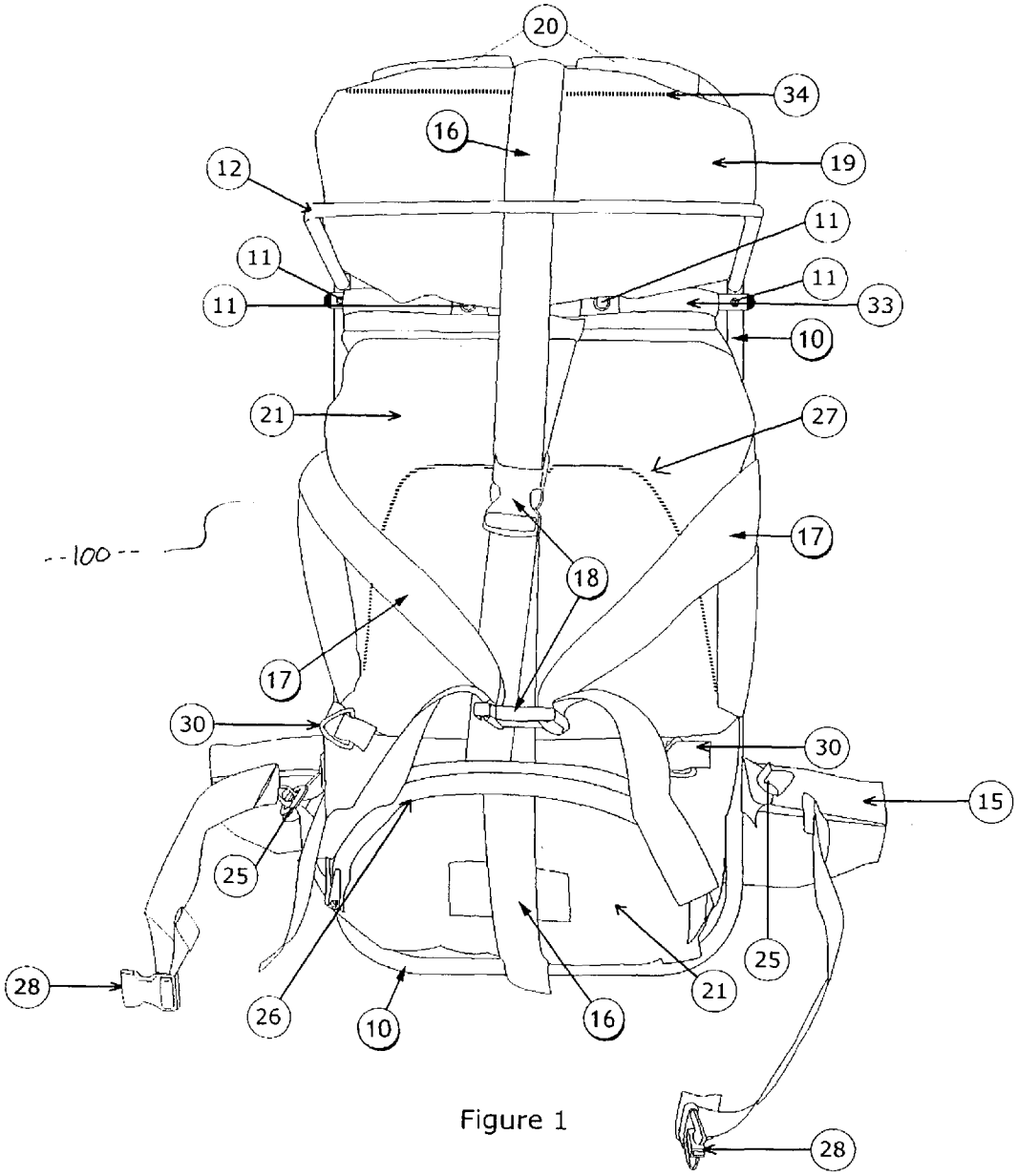
FIG. 1 is a diagrammatical representation of the back of the beach equipment carrying apparatus of the present invention.

The hanger(s) 12 can be fixed to the frame by any commonly known or used method, such as rivets, screws, bolts, etc., and can also be hinged via a hinging mechanism 31 and collapsible, so as to be flush against pack 100 when not in use. The hanger(s) 12 can be made from any commonly known or available rigid material such as aluminum and can be made as separate flat bars extending from each side of the vertical support, or can be a single "U" shaped member extending from one vertical support 10 to the other, as shown in the Figures. It is noted that in the preferred embodiment of the present invention, the hanger 12 is made "U"-shaped as shown in the drawings, and the projecting portions of the "U"-shape are secured the vertical portions of the frame 10, as shown in the Figures. This configuration provides a more stable configuration for the hanger 12. It is also noted that in the preferred embodiment of the present invention, it is desirable that the hanger(s) 12 be angled upward with respect to a plane normal to the frame 10, as shown in FIGS. 1 and 3-4. This angling of the hanger(s) 12 ensures that a beach chair (or similar item) placed on the hanger(s) 12 does not slide off during use. Further, in a configuration where the hanger(s) 12 are made hinged, it is desirable that a locking mechanism be used to lock the hanger(s) 12 in both the upper and lowered position. The locking mechanism can be by any suitable means, such as quick-release pins, springs, mechanical locks, etc. It is further contemplated that the hanger(s) 12 can be made to be positionable (and locked) in more than the upper and lower position, such that the hanger(s) 12 can be locked in a plurality of angled positions with respect to the frame. This would provide the maximum flexibility to the user of the apparatus.

Vertical and horizontal straps 16 and 17 are used to further secure the chairs or other items to the apparatus. The vertical and horizontal straps, 16 and 17, are secured to the frame with fasteners 11, which can include screws, rivets, bolts and equivalents thereto, but can also be made detachable, and be fitted with quick release buckles 18. In the preferred embodiment of the present invention, it is desirable that the straps 16 and 17 be positioned such that they will be outside of all of the compartments and items secured to the apparatus 100 so as to provide maximum security for any items placed on the apparatus. It is noted that alternatives to the quick release buckles 18 can include Velcro, and any other commonly used releasable means.

It is further noted that in another preferred embodiment of the present invention, the positioning of the hanger(s) 12 is such that when beach chairs, or the like, are secured on the hanger(s) 12, the combination of the chairs and the bottom portion of the frame 10 create a stable base for the device 100, such that when the loaded device 100 is placed on the ground it stands upright without requiring additional support. Essentially, the combination of the beach chair frames (not shown) and the frame 10 create a stable platform on which the device 100 can remain upright when placed on the ground. This allows easy access to all of the compartments as well as allowing a user to easily pick up the device.

Figure 2:
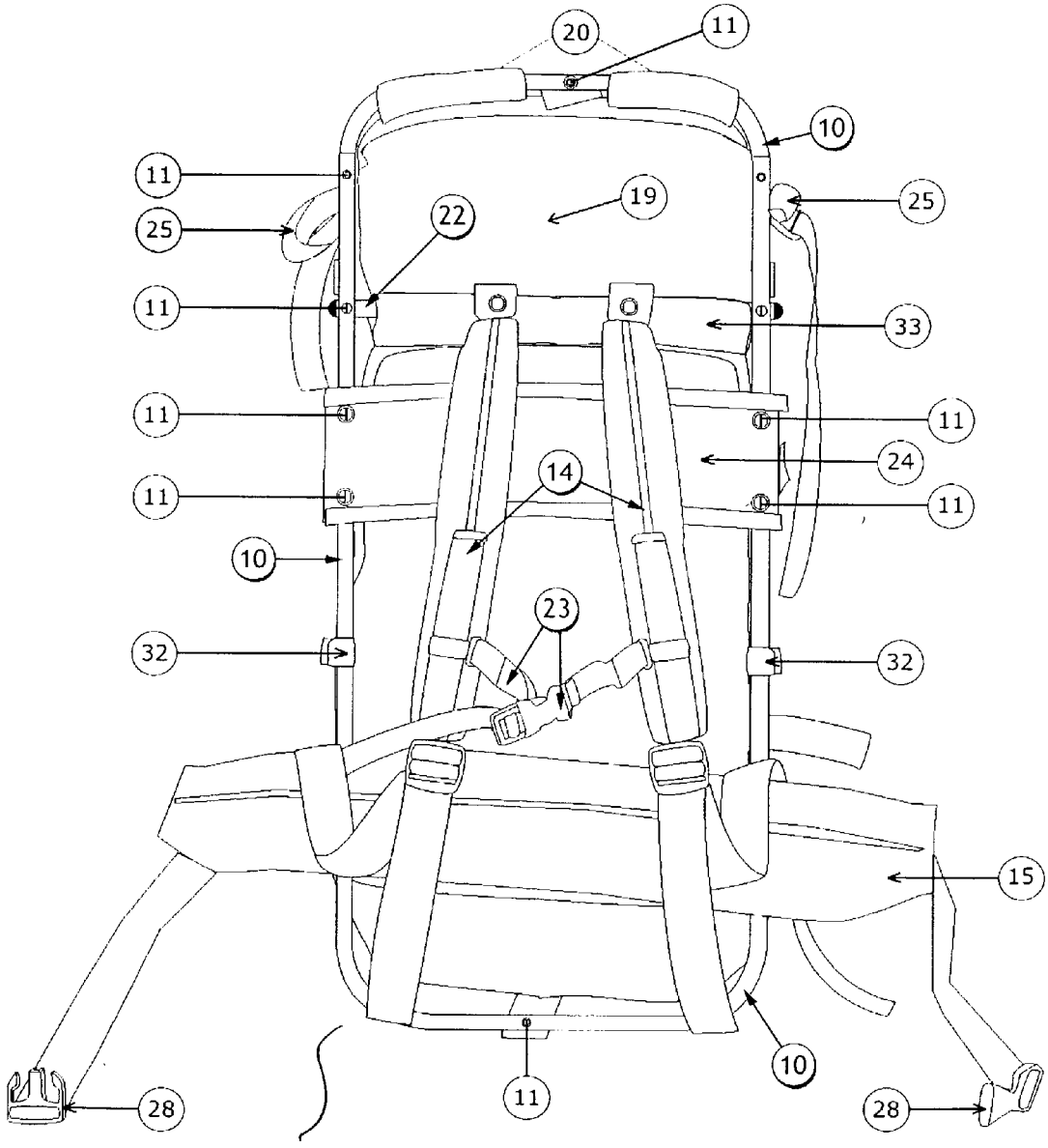
FIG. 2 is a diagrammatical representation of the front of the beach equipment carrying apparatus of the present invention.

The present invention also includes an upper mesh zippered bag 19, which is secured to the upper horizontal frame tubing via sewn loops 20, which may be detachable. The loops 20 can also be made detachable by using Velcro, snaps or other known materials and means. The bag 19 is positioned such that in its normal position it is located between the projection portions of the hanger(s) 12, as shown in FIGS. 1-3. Having the bag 19 secured to the top of the frame 10 allows the upper bag 19 to swing out and away so the chairs can be hung from the hanger(s) 12. The upper bag 19 helps to simplify the loading of at least one foldable chair, as shown in FIG. 4. As seen in FIG. 4, the bag 19 flips over the pack allowing access to the hangers 12. This allows at least one chair to be placed on the hanger(s) 12 and then the bag 19 is flipped over (i.e. to its normal position) for loading of various items within the bag 19. As shown in the Figures, the upper bag 19 has a zippered closure 34, however, it is contemplated that the enclosure 34 can be made sealable by any commonly known methods including, for example, snaps, buckles, and Velcro. Once the upper bag 19 is loaded, it fits into the cavity formed by the hanging chairs and the back of the frame 10. This feature helps secure the chairs to the frame 10 and makes the loaded pack more compact. It also provides a convenient place to load beach blankets, towels or other items. A "wave board" or "boogie board" can also be added to the items to be carried by using the horizontal 16 and 17 securing straps.

In the preferred embodiment of the present invention, there is a multi-compartment zippered bag 21 that can be secured at a horizontal frame member with sewn loops 33 or other securing devices like bolts, rivets, screws, Velcro, snaps or buckles. The upper part of the multi-compartment bag 21 is partially mesh with a zipper 27. The lower portion of this bag is a solid pack material with a zippered front 26 made to accommodate a modest sized insulated cooler, plus other materials and supplies. In addition, separate pockets or pouches 29 can be attached to the sides of the multi-compartment bag 21 to carry smaller items. The multi-compartment bag 21 is further secured with readily detachable straps 32 which attach to the vertical members or portions of the frame 10 with fasteners 11, or any other known fastening means or methods. This allows for adjustment dependent on the materials carried in the pack compartments. The bag 21 is further designed so as to conveniently fit in a cavity formed by the frame 10 and the frames of the chairs hung on the hanger(s) 12, to ensure that the bag 21 does not interfere with the back of the individual carrying the apparatus 100.

The beach equipment carrying apparatus 100 also has a pair of padded shoulder straps 14. The upper end of each strap 14 is attached to a horizontal member 22 of the external frame 10, by fasteners 11 or any other known means, and the lower end of each strap 14 can be attached to the lower portion of the vertical frame 10 members in the same or similar fashion. In the preferred embodiment the shoulder straps 14 are made adjustable so as to allow the user to adjust the straps 14 for the most comfortable feel. It is also noted that the lower ends of the straps can be secured to the bottom horizontal portion of the frame 10. The shoulder strap assembly also comes with an adjustable sternum strap 23 which is equipped with a snap on/off clip 28 (side release buckles or equivalents thereof).

At the bottom of the apparatus 100 is an adjustable hip/waist belt 15. Each half of the belt 15 has snap on/off clips 28 to allow ease of release. Each half of the belt 15 is attached at the base of the frame 10 vertical portions. The apparatus can come with either a padded or unpadded hip/waist belt 15.

It is further contemplated that the lower sections of the apparatus have side pouches 29 and key loops 30 for storing and attaching assorted beach accessories. There is also a webbed cushion 24 located at mid-pack and at the bottom of the frame 10 to protect the persons back from the pack load. There is also at least one pair of umbrella straps 25 on either side of the pack vertical members to secure beach umbrellas or other items.

It is further noted that each of pockets or storage compartments of the present invention can be made of any commonly know or used material, including but not limited to nylon, polyester, mesh fabric, etc., and that these compartments can be manufactured by any commonly known methods including sewing, staples, adhesion, etc.

The unique dimensions and design of this apparatus allows the apparatus to be free standing once loaded with the accessories and chairs. The frame may also be made adjustable to accommodate users of various heights.

It is of course understood that departures can be made from the preferred embodiments of the invention by those of ordinary skill in the art without departing from the spirit and scope of the invention that is limited only by the following claims.

The invention claimed is:

1. A beach equipment carrying apparatus, comprising:

a frame member, with a top portion, bottom portion and side portions;

a hanger member secured to an upper portion of said side portions of said frame member and having at least two projection portions;

a plurality of compaitments secured to said frame member, wherein at least one of said compartments is secured to said top portion of said frame member and is positioned to be located between said at least two projection portions; and at least one shoulder strap secured to said frame member, wherein said hanger member is angled upward with respect to a line extending normal to a plane of said upper portion of said side portions of said frame member where said hanger member is secured.

2. The beach equipment carrying apparatus of claim 1, wherein said at least one of said compartments is pivotably secured to said frame member.

3. The beach equipment carrying apparatus of claim 1, wherein said at least one of said compartments is both pivotably and removably secured to said frame member.

4. The beach equipment carrying apparatus of claim 1, further comprising at least one vertical strap connected to said top portion of said frame member and said bottom portion of said frame member, and at least one horizontal strap connected to said side portions of said frame member.

5. The beach equipment carrying apparatus of claim 1, further comprising at least one horizontal support strap positioned between said side portions of said frame member and positioned between said at least one shoulder strap and said plurality of compartments.

6. The beach equipment carrying apparatus of claim 1, wherein each of said plurality of compartments are removably secured to said frame member.

7. The beach equipment carrying apparatus of claim 4, wherein each of said at least one vertical strap and said at least one horizontal strap comprise a releasable connector, 8. The beach equipment carrying apparatus of claim 1, wherein said frame member is rectangular in shape.

9. The beach equipment carrying apparatus of claim 1, wherein said at least two projection portions are made integrally with a remaining portion of said hanger member.

10. The beach equipment carrying apparatus of claim 1, wherein said hanger member is substantially U-shaped, and wherein said at least two projection portions comprise the legs of said U-shape.

11. The beach equipment carrying apparatus of claim 1, wherein said frame member includes at least one horizontal frame member positioned between said top portion and said bottom portion of said frame member, and said at least one horizontal frame member is secured to vertical portions of said frame member.

12. The beach equipment carrying apparatus of claim 11, wherein at least one other of said compartments is secured to said horizontal frame member.

13. The beach equipment carrying apparatus of claim 11, wherein a top end of said at least one shoulder strap is secured to said horizontal frame member.

14. A beach equipment carrying apparatus, comprising:

a frame member having at least two vertical portions, a top portion and a bottom portion;

a hanger member secured to an upper portion of said frame member and having at least two projection portions, wherein an end of each of said projection portions is secured to one of said vertical portions of said frame member and said other end of said projection portions are angled upward with respect to a line extending normal to a plane of said upper portion of said frame member where said hanger member is secured;

a plurality of compartments secured to said frame member, wherein at least one of said plurality of compartments is secured to said top portion of said frame member; and at least two shoulder straps secured to said frame member.

15. The beach equipment carrying apparatus of claim 14, wherein said hanger member is pivotably secured to said frame member.

16. The beach equipment carrying apparatus of claim 14, wherein said frame member has an adjustable height.

17. The beach equipment carrying apparatus of claim 14, wherein at least one of said plurality of compartments positioned to be located between said at least two projection portions and is pivotably secured to said frame member.

18. The beach equipment carrying apparatus of claim 14, further comprising at least one vertical strap connected to said top portion of said frame member and said bottom portion of said frame member, and at least one horizontal strap connected to said vertical portions of said frame member.

19. The beach equipment carrying apparatus of claim 14, further comprising at least one horizontal support strap secured to and positioned between said vertical portions of said frame member and positioned between said at least one shoulder strap and said plurality of compartments.

20. The beach equipment carrying apparatus of claim 14, wherein each of said plurality of compartments are removably secured to said frame member.

21. The beach equipment carrying apparatus of claim 18, wherein each of said at least one vertical strap and said at least one horizontal strap comprise a releasable connector.

22. The beach equipment carrying apparatus of claim 14, wherein said frame member is rectangular in shape.

23. The beach equipment carrying apparatus of claim 14, wherein said at least two projection portions are made integrally with a remaining portion of said hanger member.

24. The beach equipment carrying apparatus of claim 14, wherein said hanger member is substantially U-shaped, and wherein said at least two projection portions comprise the legs of said U-shape.

25. The beach equipment carrying apparatus of claim 14, wherein said frame member includes at least one horizontal frame member positioned between said top portion and said bottom portion of said frame member, and said at least one horizontal frame member is secured to said vertical portions of said frame member.

26. The beach equipment carrying appratatus of claim 25, wherein at least one other of said compartments is secured to said horizontal frame member.

27. The beach equipment carrying apparatus of claim 25, wherein a top end of said at least two shoulder straps are secured to said horizontal frame member.

* * * * *